US008661947B1

(12) United States Patent
Ou

(10) Patent No.: US 8,661,947 B1
(45) Date of Patent: Mar. 4, 2014

(54) THREE-MODE DIRECTION-CHANGEABLE RATCHET WRENCH

(71) Applicant: Yu-Hua Ou, Taichung (TW)

(72) Inventor: Yu-Hua Ou, Taichung (TW)

( * ) Notice: Subject to any disclaimer, the term of this patent is extended or adjusted under 35 U.S.C. 154(b) by 0 days.

(21) Appl. No.: 13/747,243

(22) Filed: Jan. 22, 2013

(51) Int. Cl.
*B25B 13/46* (2006.01)

(52) U.S. Cl.
CPC ..... *B25B 13/463* (2013.01); *B25B 13/465* (2013.01); *B25B 13/462* (2013.01); *B25B 13/461* (2013.01)
USPC ..... 81/63.1; 81/63; 192/43.2

(58) Field of Classification Search
CPC ..... B25B 13/00
USPC ..... 81/58–63.2; 192/43–44
See application file for complete search history.

(56) References Cited

U.S. PATENT DOCUMENTS 726,012 A * 4/1903 Andrew ..... 81/62
2,906,194 A * 9/1959 Schwaneke ..... 99/329 R
3,078,973 A * 2/1963 Kilness ..... 192/43.2
4,982,627 A * 1/1991 Johnson ..... 81/121.1
5,351,583 A * 10/1994 Szymber et al. ..... 81/60
5,622,089 A * 4/1997 Gifford, Sr. ..... 81/62
6,044,730 A * 4/2000 Roberts et al. ..... 81/63
6,205,890 B1 * 3/2001 Roberts et al. ..... 81/63
6,308,594 B1 * 10/2001 Cheng ..... 81/62
7,263,918 B1 * 9/2007 Chen ..... 81/63.1
8,261,636 B2 * 9/2012 Lin ..... 81/63.1
2005/0257650 A1 * 11/2005 Hu ..... 81/63.1
2008/0006125 A1 * 1/2008 Chen ..... 81/63.1
2009/0320649 A1 * 12/2009 Hu ..... 81/63.1
2010/0288082 A1 * 11/2010 Huang ..... 81/63.1
2012/0272793 A1 * 11/2012 Lin ..... 81/63
2013/0228048 A1 * 9/2013 Lai ..... 81/63.1

* cited by examiner

*Primary Examiner* — Monica Carter
*Assistant Examiner* — Melanie Alexander

(57) ABSTRACT

A three-mode direction-changeable ratchet wrench of the present invention includes a main body, a ratchet member, a ratchet mechanism, a switch mechanism having a toggle piece, and a restriction element. The main body includes a head portion and a handle, and the ratchet member is rotatably disposed to the head portion. The ratchet mechanism includes a first pawl, a second pawl, a first elastic element, and a second elastic element. The switch mechanism is disposed on the head portion. The restriction element is disposed on one of the main body and the switch mechanism and is movable between a restrict position and a release position. Thereby, the restriction element is able to alternatively restrict the toggle piece.

4 Claims, 6 Drawing Sheets

THREE-MODE DIRECTION-CHANGEABLE RATCHET WRENCH

BACKGROUND OF THE INVENTION

1. Field of the Invention

The present invention relates to a wrench, more especially to a ratchet wrench.

2. Description of the Prior Art

A conventional three-mode direction-changeable wrench includes a switch mechanism which is able to rotate with respect to a head portion between a first, a second, and a third positions so as to toggle two pawls to change direction of ratchet member. Alternatively, the two pawls can be engaged with the ratchet member at the same time so that the ratchet member is unable to rotate and is adapted for being used as a normal wrench head.

However, the wrench mentioned above has some problems. When the switch mechanism is located at the second position, the switch mechanism may move toward the first or the third position when being pressed accidentally. Thus, it is inconvenient that the ratchet member is switched from a normal wrench mode to an idling mode ratchet member.

SUMMARY OF THE INVENTION

The main object of the present invention is to provide a three-mode ratchet wrench which is able to restrict the switch mechanism at the second position by a restriction element so as to prevent the switch mechanism from moving toward the first position or the third position.

To achieve the above and other objects, a three-mode direction-changeable ratchet wrench of the present invention includes a main body, a ratchet member, a ratchet mechanism, a switch mechanism, and a restriction element.

The main body includes a head portion and a handle. The head portion encloses a first receiving room and a second receiving room wherein the first receiving room communicates with the second receiving room. The head portion has a first face. The handle is disposed to the head portion.

The ratchet member is rotatably disposed in the first receiving room.

The ratchet mechanism includes a first pawl, a second pawl, a first elastic element, and a second elastic element. The first pawl and the second pawl are disposed in the second receiving room respectively. The first and the second elastic elements are disposed in the second receiving room and abut against the first pawl and the second pawl respectively so that the first pawl and second pawl tend to move toward the ratchet member.

The switch mechanism is disposed on the head portion and is movable with respect to the head portion between a first position, a second position, and a third position. When the switch mechanism is located at the second position, the first pawl is pushed away from the ratchet member by the switch mechanism, and the switch mechanism is away from the second pawl so that the second pawl is engaged with the ratchet member due to elasticity of the second elastic element. When the switch mechanism is located at the second position, the first and the second pawls are both engaged with the ratchet member. When the switch mechanism is located at the third position, the second pawl is pushed away from the ratchet member by the switch mechanism, and the switch mechanism is away from the first pawl so that the first pawl is engaged with the ratchet member due to elasticity of the first elastic element.

The restriction element is disposed on one of the main body and the switch mechanism and is movable between a restrict position and a release position. When the switch mechanism is located at the second position and the restriction element is located at the restrict position, the switch mechanism is restricted by the restriction element and is unmovable. When the restriction element is located at the release position, the switch mechanism is movable between the first, the second, and the third positions.

Thereby, the three-mode direction-changeable ratchet wrench of the present invention provides a restriction element for restricting a toggle piece at the second position. Thus, the toggle piece is prevented from moving toward the first position or the third position when being pressed accidentally.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
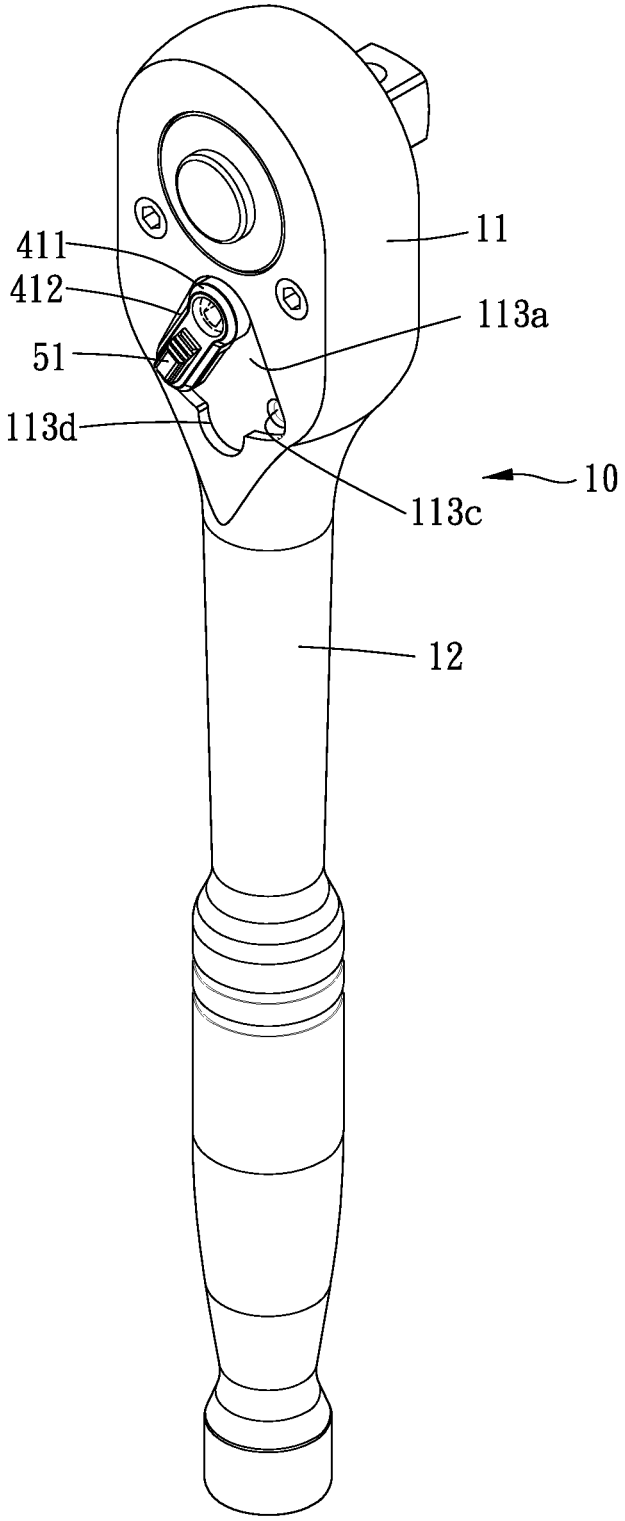
FIG. 1 is a stereogram showing a first embodiment of the present invention.
Figure 2:
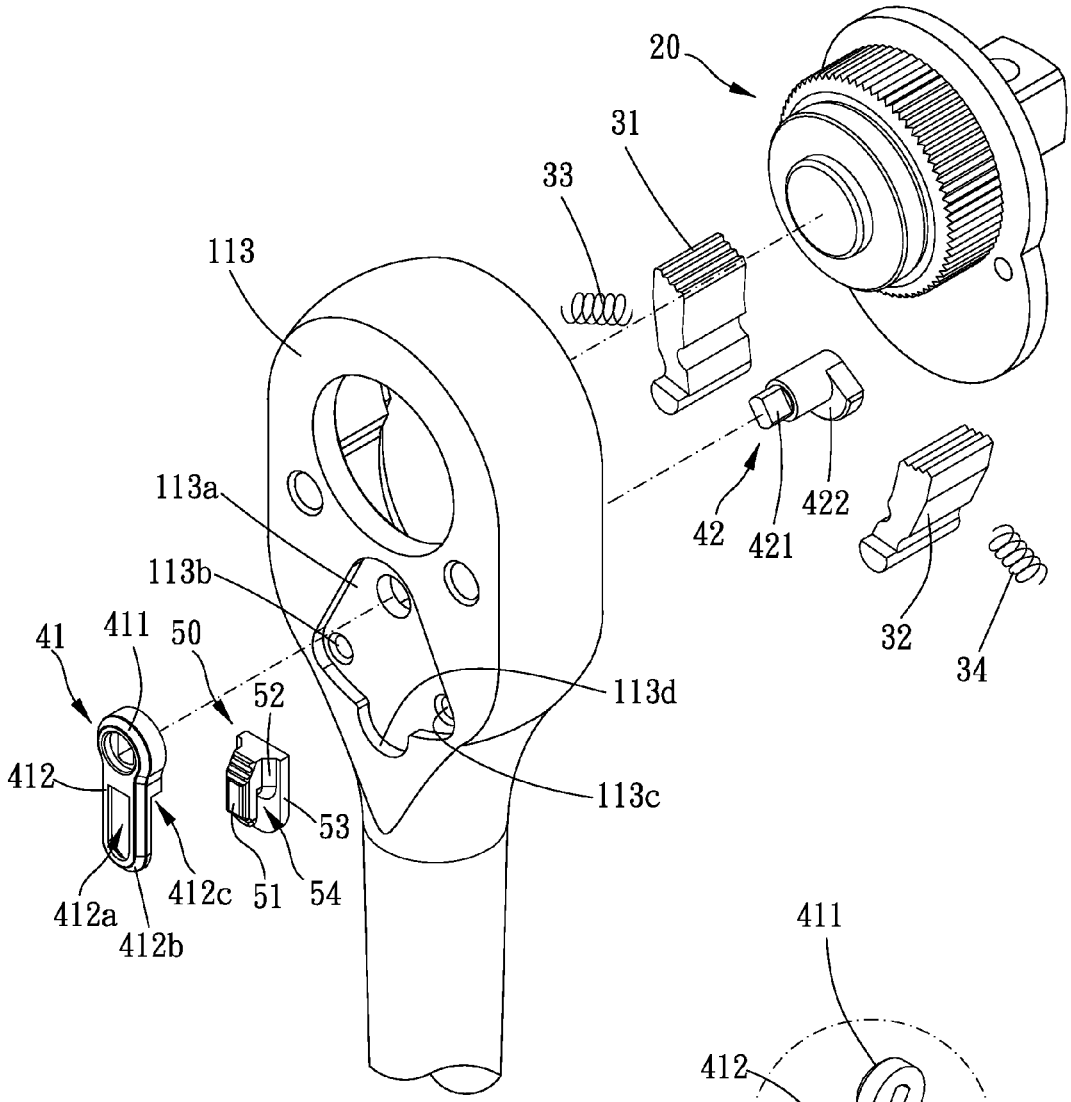
FIG. 2 is a breakdown drawing showing a first embodiment of the present invention.
Figure 2A:
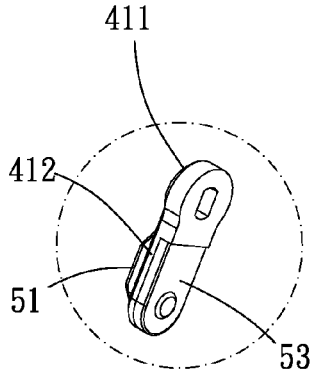
FIG. 2A is stereogram of a restriction element showing a first embodiment of the present invention.
Figure 3:
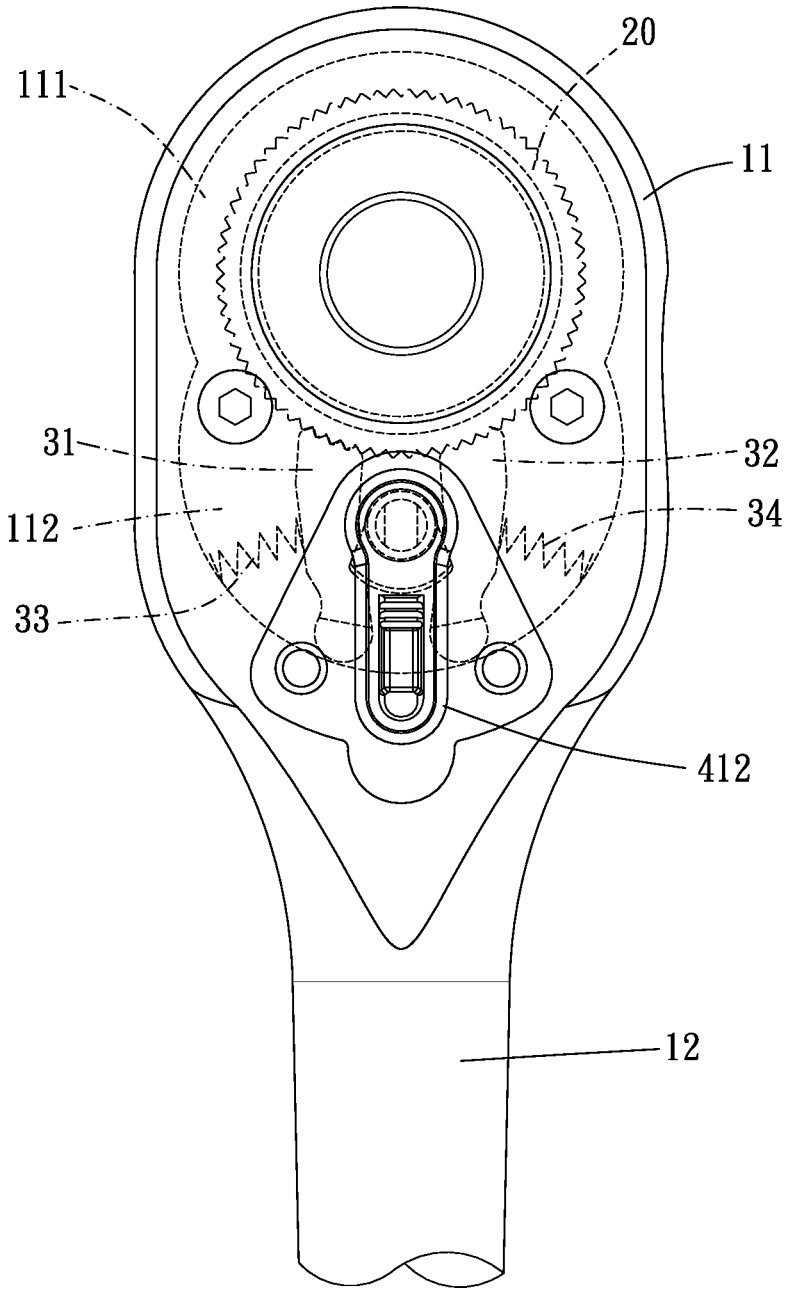
FIG. 3 is a perspective drawing of a head portion showing a first embodiment of the present invention when a toggle portion is located at a second position.

Please refer to FIG. 1 to FIG. 3. The three-mode direction-changeable ratchet wrench of the present invention includes a main body 10, a ratchet member 20, a ratchet mechanism, a switch mechanism, and a restriction element 50.

The main body 10 includes a head portion 11 and a handle 12 disposed to the head portion 11. The head portion encloses a first receiving room 111 and a second receiving room 112 wherein the first receiving room 111 communicates with the second receiving room 112. The head portion 11 has a first face 113 and a second face. Each of the first face and the second face forms a through hole, and the two through holes communicate with the first receiving room respectively. The head portion 11 forms a receiving slot 113*a* on the first face 113, and a first identification portion 113*b* and a second identification portion 113*c* are disposed on the first face 113 wherein the first and the second identification portions 113*b*, 113*c* are different in colors. Preferably, the first and the second identification portions 113*b*, 113*c* are disposed on a bottom of the receiving slot 113*a*. In addition, the head portion 11 further has a positioning portion on the first face 113.

The ratchet member 20 is rotatably disposed in the first receiving room 111 and corresponds to the two through holes. The ratchet member 20 has a plurality of teeth annularly arranged on an outer surface. In practice, the ratchet member 20 can have a polygonal hole to be a normal ratchet wrench or have a socket to be a socket ratchet wrench.

The ratchet mechanism includes a first pawl 31, a second pawl 32, a first elastic element 33, and a second elastic element 34. The first pawl 31 is disposed in the second receiving room 112 and has a plurality of teeth. Similarly, the second pawl 32 is disposed in the second receiving room 112 and also has a plurality of teeth. The first and the second elastic elements 33, 34 are disposed in the second receiving room 112 and abut against the first and the second pawls 31, 32 respectively so that the first and the second pawls 31, 32 tend to move toward the ratchet member 20.

The switch mechanism is disposed on the head portion 11 and is movable with respect to the head portion 11 between a first position, a second position, and a third position. Specifically, the switch mechanism includes a toggle portion 41 and a pushing portion 42. The toggle portion 41 is rotatably disposed in the receiving slot 113*a*. The pushing portion 42 is linked-up with the toggle portion 41 and is located between the first pawl 31 and the second pawl 32. Preferably, the toggle portion 41 includes a rotating portion 411 and a toggle piece 412. The toggle piece 412 integrally extends from the rotating portion 411 and is movable with respect to the head portion 11 between the first position, the second position, and the third position. The pushing portion 42 includes an axle portion 421 and a pressing piece 422. The axle portion 421 is inserted through the first face 113 of the head portion 11. An end of the axle portion 421 is connected with the rotating portion 411, and an opposite end of the axle portion 421 is connected with the pressing piece 422. The pressing piece 422 is received in the second receiving room 112 and is located between the first pawl 31 and the second pawl 32. In the present embodiment, the toggle piece 412 forms a longitudinal slot 412*a*. The longitudinal slot 412*a* extends along a longitudinal direction of the toggle piece 412 and penetrates a top and a bottom of the toggle piece 412 but not a free end of the toggle piece 412. The toggle piece 412 forms a recessed sliding space 412*c* on the bottom, and the longitudinal slot 412*a* communicates with the sliding space 412*c*.

The restriction element 50 is disposed on one of the main body 10 and the switch mechanism and is movable between a restrict position and a release position. In the present embodiment, the restriction element 50 is slidably disposed on the toggle portion 41. More specifically, the restriction element 50 includes a pressing portion 51, a sliding portion 52, and a base portion 53. The sliding portion 52 is located between the pressing portion 51 and the base portion 53, and a restriction space 54 is enclosed by the pressing portion 51, the sliding portion 52, and the base portion 53. The sliding portion 52 is located in the longitudinal slot 412*a*. The pressing portion 51 is exposed out of the longitudinal slot 412*a*. The base portion 53 is slidably disposed in the sliding space 412*c*.

In use, please refer to FIGS. 1 and 2, when the toggle piece 412 is switched to the first position, the rotating portion 411 drives the axle portion 421 of the pushing portion 42 to rotate so that the first pawl 31 is pushed away from the ratchet member 20 by the pressing piece 422. At this time, the pressing piece 422 is away from the second pawl 32 so that the second pawl 32 is engaged with the ratchet member 20 due to elasticity of the second elastic element 34. Thus, the ratchet member 20 is able to drive a workpiece to rotate when rotated clockwise and to idle when rotated counterclockwise. In addition, the toggle piece 412 corresponds to the first identification portion 113*b*.

Figure 4:
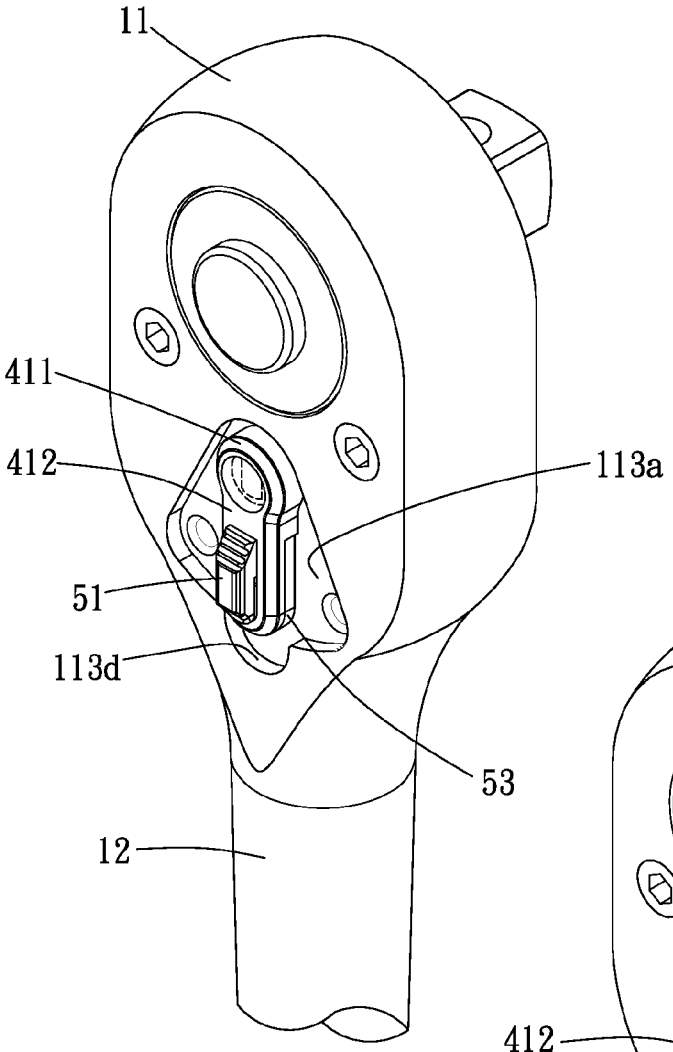
FIG. 4 is an illustration showing a first embodiment of the present invention when a restriction element is located at a release position and a toggle portion is located at a second position.

Please refer to FIGS. 3 and 4. When the toggle piece 412 is switched to the second position, the first and the second pawls 31, 32 are both engaged with the ratchet member 20. Thereby, the ratchet member 30 is restricted by the first and the second pawls 31, 32 and is unable to rotate with respect to the head portion 11, so the ratchet member 20 can be used as a normal driving head.

Figure 6:
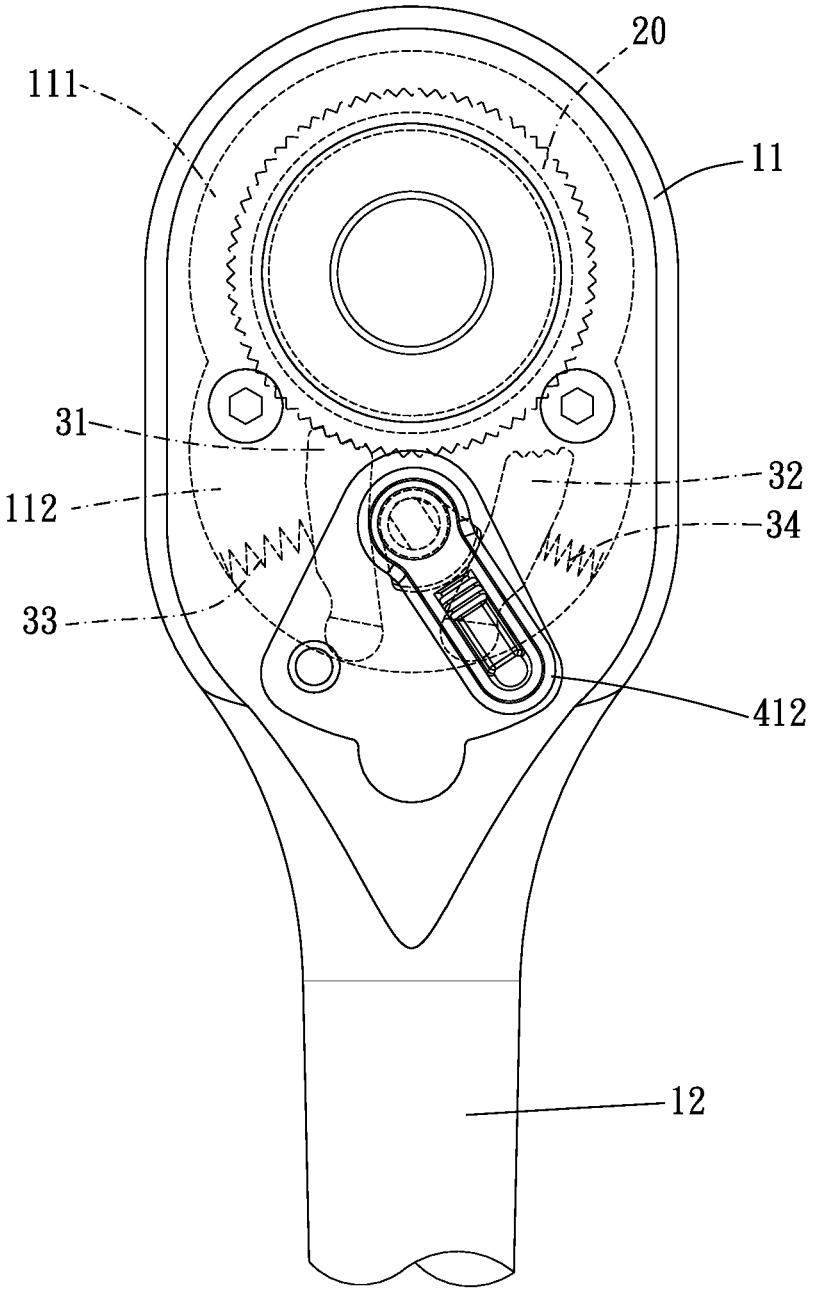
FIG. 6 is a perspective drawing of the head portion showing a first embodiment of the present invention when the toggle portion is located at the third position.

Please refer to FIG. 6 in view of FIG. 2. When the toggle piece 412 is switched to the third position, the rotating portion 411 drives the axle portion 421 of the pushing portion 42 to rotate so that the second pawl 32 is pushed away from the ratchet member 20 by the pressing piece 422. At this time, the pressing piece 422 is away from the first pawl 31 so that the first pawl 31 is engaged with the ratchet member 20 due to elasticity of the first elastic element 33. Thus, the ratchet member 20 is able to drive a workpiece to rotate when rotated counterclockwise and to idle when rotated clockwise. In addition, the toggle piece 412 corresponds to the second identification portion 113*c*.

Figure 5:
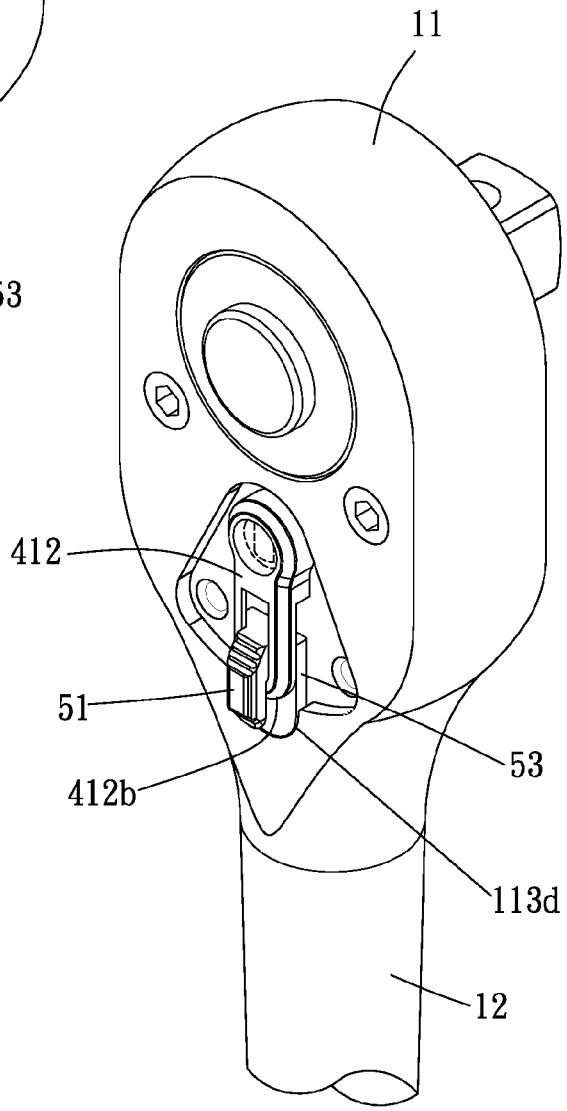
FIG. 5 is an illustration showing a first embodiment of the present invention when a toggle portion is restricted at a second position by a restriction element.

Please refer to FIG. 5 in view of FIG. 2, when the toggle piece 412 is switched to the second position, the restriction element can be moved to the restrict position from the toggle piece 412. Thus, the restriction element is partially located at the positioning portion and partially located at the toggle piece 412. More specifically, the positioning portion is a sliding slot 113*d* communicating with the receiving slot 113*a*. The base portion 53 is partially in the sliding slot 113*d*, and the free end 412*b* of the toggle piece 412 is located in the restriction space. Thereby, the toggle piece 412 is restricted by the restriction element and is unmovable so that the toggle piece 412 is prevented from moving toward the first position or the third position. Please refer to FIGS. 3 and 4, when the restriction element is moved to the release position, the restriction element moves back to the toggle piece 412 away from the sliding slot 113*d*. Thereby, the toggle piece 412 is not restricted by the restriction element and is able to move between the first, the second, and the third positions.

Figure 7:
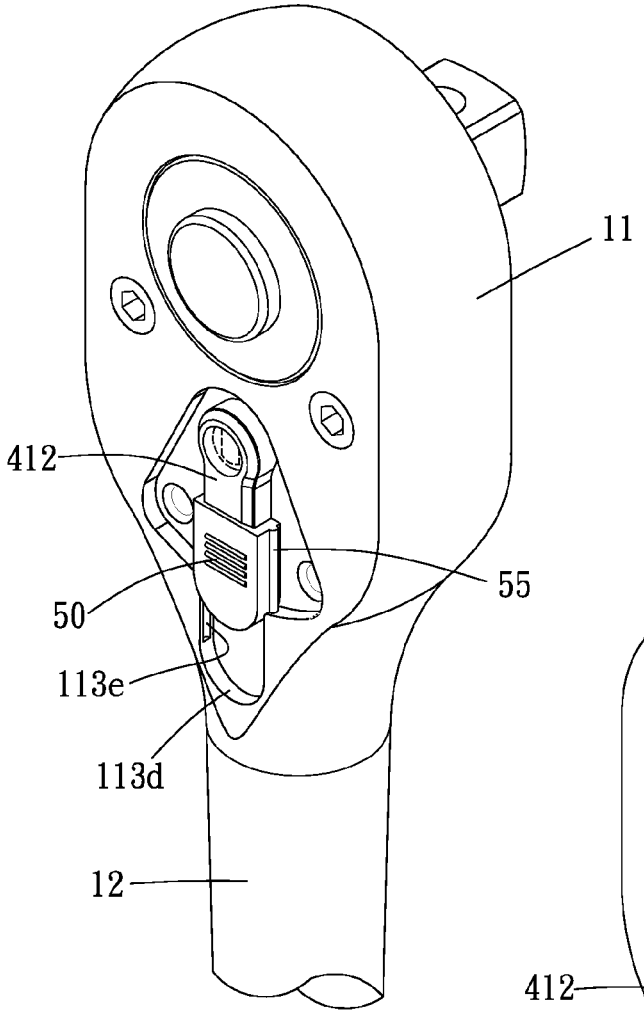
FIG. 7 is an illustration showing a second embodiment of the present invention when a toggle portion is restricted at a second position by a restriction element.
Figure 8:
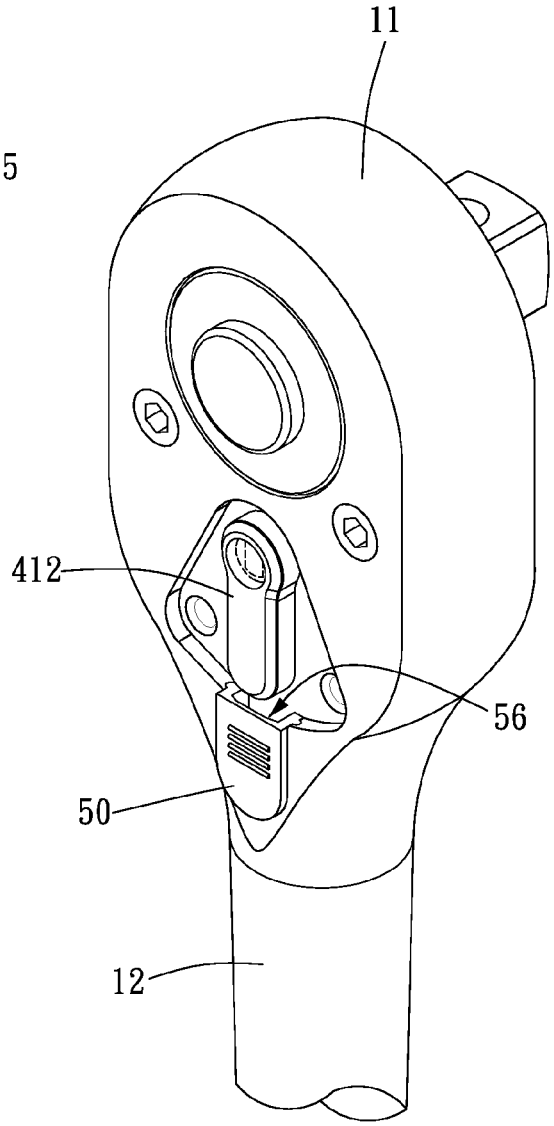
FIG. 8 is an illustration showing a second embodiment of the present invention when a toggle portion is located at a second position.

Please refer to FIGS. 7 and 8 for another embodiment of the present invention. The restriction element 50 is slidably disposed in the sliding slot 113*d*. More specifically, two sliding grooves 113*e* are formed on an inner wall of the sliding slot 113*d*. Correspondingly, the restriction element forms two protruding sliding tracks 55 and encloses a recessed slot 56. The two sliding tracks 55 are slidably disposed in the two sliding grooves 113*e* respectively. Please refer to FIG. 7, when the toggle piece 412 is located at the second position and the restriction element 50 is located at the restrict position, the restriction element 50 is partially exposed out of the sliding slot 113*d* so that the toggle piece 412 is covered by the recessed slot and is unmovable. Thereby, the toggle piece 412 is prevented from moving toward the first position or the third position. Please refer to FIG. 8, when the restriction element 50 is moved to the release position, the restriction element 50 moves back to the sliding slot away from the toggle piece 412.

Thereby, the three-mode direction-changeable ratchet wrench of the present invention provides a restriction element 50 for alternatively restricting the toggle piece 412 at the second position. Thus, the toggle piece 412 can be prevented from being accidentally moved toward the first position or the third position.

Furthermore, the differently-colored first and second identification portions 113*b*, 113*c* can be adapted for a user to identify the driving direction of the ratchet member 20. Besides, the receiving slot 113*a* can further have a third identification portion (not shown in drawings) on its bottom wherein the third identification portion is different from the first and the second identification portions in color. The toggle element 412 corresponds to the third identification portion when located at the second position. That is, the third identification portion is adapted for indicate that the ratchet member 20 is used as a normal driving head.

What is claimed is:

1. A three-mode direction-changeable ratchet wrench, comprising:

a main body, including a head portion and a handle, the head portion enclosing a first receiving room and a second receiving room, the first receiving room communicating with the second receiving room, the head portion having a first face, the handle being connected with the head portion;

a ratchet member, rotatably disposed in the first receiving room;

a ratchet mechanism, including a first pawl, a second pawl, a first elastic element, and a second elastic element, the first and the second pawl being disposed in the second receiving room respectively, the first and the second elastic elements being disposed in the second receiving room and abutting against the first and the second pawls respectively so that the first and the second pawls tends to move toward the ratchet member;

a switch mechanism, being disposed on the head portion and being able to be switched between a first position, a second position, and a third position, the first pawl being pushed away from the ratchet member by the switch mechanism and the switch mechanism is away from the second pawl when the switch mechanism is located at the first position so that the second pawl is engaged with the ratchet member due to elasticity of the second elastic element, the first and the second pawls being both engaged with the ratchet member when the switch mechanism is located at the second position, the second pawl being pushed away from the ratchet member by the switch mechanism and the switch mechanism is away from the first pawl when the switch mechanism is located at the third position so that the first pawl is engaged with the ratchet member due to elasticity of the first elastic element;

a restriction element, being disposed on one of the main body and the switch mechanism and being able to move between a restrict position and a release position, the switch mechanism being restricted by the restriction element so as not to move when the switch mechanism is located at the second position and the restriction element is located at the restrict position, the switch mechanism being able to move between the first, the second, and the third positions when the restriction element is located at the release position;

wherein the head portion has a positioning portion on the first face, when the switch mechanism is located at the second position and the restriction element is located at the restrict position, the restrict element is partially in the positioning portion and partially in the switch mechanism wherein the head portion forms a receiving slot on the first face, the positioning portion is a sliding slot, the sliding slot communicates with the receiving slot, the switch mechanism includes a toggle portion and a pushing portion, the toggle portion is rotatably disposed in the receiving slot, the pushing portion is linking-up with the toggle portion and is located between the first and the second pawls, the restriction element is slidably disposed to one of the sliding slot and the toggle portion, the restriction element is partially in the sliding slot and partially in at the toggle portion when the switch mechanism is located at the second position and the restriction element is located at the restrict position, the restriction element is away from the one of the sliding slot and the toggle portion when the restriction element is located at the release position.

2. The three-mode direction-changeable ratchet wrench of claim 1, wherein the toggle portion includes a rotating portion and a toggle piece, the rotating portion is linked-up with the pushing portion, the toggle piece integrally extends from the rotating portion, the toggle piece forms a longitudinal slot, a sliding space is formed on a bottom of the toggle piece, the restriction element includes a pressing portion, a sliding portion, and a base portion, the sliding portion is disposed between the pressing portion and the base portion, a restriction space is enclosed by the sliding portion, the pressing portion, and the base portion, the sliding portion is disposed in the longitudinal slot, the pressing portion is exposed out of the longitudinal slot, the base portion is slidably disposed in the sliding space, the base portion partially slides into the sliding slot and a free end of the toggle piece is located in the restriction space when the switch mechanism is located at the second position, the restriction element moves back to the toggle piece away from the sliding slot when the restriction element is located at the release position.

3. The three-mode direction-changeable ratchet wrench of claim 1, wherein the toggle portion includes a rotating portion and a toggle piece, the rotating portion is linked-up with the pushing portion, the toggle piece integrally extends from the rotating portion, one of an inner wall of the sliding slot and the restriction element forms two sliding grooves, another one of the inner wall of the sliding slot and the restriction element forms two protruding sliding tracks, the sliding tracks are slidably disposed in the sliding grooves respectively, the restriction element is partially in the sliding slot and partially at the toggle piece when the switch mechanism is located at the second position and the restriction element is located at the restrict position, the restriction element moves back to the sliding slot away from the toggle piece when the restriction element is located at the release position.

4. The three-mode direction-changeable ratchet wrench of claim 1, wherein the head portion has a first identification portion and a second identification portion, the first and the second identification portions are different in colors, the switch mechanism corresponds to the first identification portion when located at the first position, the switch mechanism corresponds to the second identification portion when located at the second position.

* * * * *